United States Patent [19]

Morikawa et al.

[11] Patent Number: 4,593,617

[45] Date of Patent: Jun. 10, 1986

[54] INK SUPPLYING APPARATUS FOR PRINTING MACHINE

[76] Inventors: Ikkyu Morikawa; Sinzi Morikawa, both of 79-1, Nishinouchi-cho, Kisshoin, Minami-ku, Kyoto-shi, Kyoto-fu, Japan

[21] Appl. No.: 701,570

[22] Filed: Feb. 14, 1985

[30] Foreign Application Priority Data

Feb. 17, 1984 [JP] Japan ..... 59-22073[U]

[51] Int. Cl.[4] ..... B41F 31/16; B41F 31/14; B41L 27/18

[52] U.S. Cl. ..... 101/350; 101/DIG. 7

[58] Field of Search ..... 101/349, 350, 351, 352, 101/363, 355, 356, 357, 358, 206, 207, 208, 209, 210, 148, DIG. 7; 118/106, 257, 261, 258

[56] References Cited

U.S. PATENT DOCUMENTS

| | | | |
|---|---|---|---|
| 2,036,451 | 4/1936 | Wood | 101/DIG. 7 |
| 4,223,603 | 9/1980 | Faddis et al. | 101/350 X |

FOREIGN PATENT DOCUMENTS

| | | | |
|---|---|---|---|
| 143459 | 4/1948 | Australia | 101/DIG. 7 |
| 2079221 | 1/1982 | United Kingdom | 101/DIG. 7 |

*Primary Examiner*—J. Reed Fisher

*Attorney, Agent, or Firm*—Webb, Burden, Robinson & Webb

[57] ABSTRACT

An ink supplying apparatus for a printing machine includes a plurality of groups of distributor rollers and an endless belt or belts extending through these groups of rollers to supply ink to a printing plate.

2 Claims, 5 Drawing Figures

INK SUPPLYING APPARATUS FOR PRINTING MACHINE

BACKGROUND OF THE INVENTION

This invention relates to an ink supplying apparatus for a printing machine, and more particularly to an apparatus for transferring ink from an ink fountain to a printing plate.

A typical apparatus heretofore used for supplying ink to a printing plate in relief printing, offset printing and the like is shown in FIG. 3 of the accompanying drawings. As seen, ink in an ink fountain 1' is taken out by a lifter roller 2' which is adapted to come into and out of contact with an ink fountain roller 1*a'*. The ink is transferred from the lifter roller 2' to one and then to another of a plurality of distributor rollers 3', 4' which are rotatable in contact with one another. The ink becomes sufficiently distributed in the course of passage through the distributor rollers 3', 4', and is passed to form inking rollers 8' and finally to a printing plate or plate cylinder 9' rotating in contact with the form inking rollers 8'.

The above ink supplying technique permits traces of image portions of the printing plate 9' to remain on the final or form inking rollers 8' as shown in FIG. 4. The form inking rollers 8' are constantly maintained in rotation and in contact with an adjacent distributor roller 4' and after one revolution the rollers 8' are replenished with an amount of ink corresponding to an amount that has been transferred to the printing plate 9'.

However, the cylinder of the printing plate 9' and the form inking rollers 8' are not in a one to one diametric relationship for reasons of design, and an image portion of the printing plate 9' does not turn around to coincide with the same position on the surface of the form inking rollers 8'. Moreover, even though ink is supplemented by the distributor roller 4' as described above, the ink cannot be applied evenly or in an equal thickness to a position on the surface of the form inking rollers 8' corresponding to the image portion and carrying a reduced amount of ink and a position on the surface of the form inking rollers 8' corresponding to a non-image portion carrying an unreduced amount of ink. Therefore, the initial loss of ink to the image portion inevitably remains on the surface of the form inking rollers 8'.

Consequently, when ink is transferred from the form inking rollers 8' after one rotation to a subsequent image portion of the printing plate 9', the ink transfer is carried out while retaining variations in ink thickness corresponding to the preceding image portion as described above. The subsequent image portion transferred from the printing plate to printing paper includes the traces of the preceding image portion, shown as shade portion G in FIG. 5. This greatly deteriorates the quality of finished prints. The shade portions G of printed images thus caused are known as ghosts.

SUMMARY OF THE INVENTION

An object of this invention is to provide an ink supplying apparatus for a printing machine capable of high quality printing by avoiding the above noted ghosts.

In order to achieve this object, an ink supplying apparatus for a printing machine for transferring ink from an ink fountain to a printing plate or plate cylinder according to this invention comprises an ink lifter roller disposed adjacent the ink fountain, a first group of distributor rollers continuous from the lifter roller and rotatable in contact with one another, a pressing cylinder opposed to the plate cylinder, an endless belt means extending between the pressing cylinder and the plate cylinder so as to contact the plate cylinder, with the endless belt means contacting at least one distributor roller in the first group of distributor rollers, and at least one further group of distributor rollers in contact with the endless belt means.

In short, the invention transfers ink by means of a belt or belts instead of transferring ink by roller to roller contact as in the prior art.

The main cause of the appearance of ghosts, which is the disadvantage of the prior art, is that the form inking rollers receive ink only from a single distributor roller rotating in contact with the form inking rollers. The present invention provides a belt to contact the printing plate or plate cylinder, which enables at least one further group of distributor rollers to be provided besides an ink supply line for transferring ink from the ink fountain through a group of distributor rollers. The above noted further group of distributor rollers is effective to make uniform the ink supplied to the surfaces of the belt by a first step which is prone to variations in thickness, whereby ink having a uniform thickness is transferred to the printing plate when the belt or belts turn round into contact with the printing plate. Thus, this invention has the advantage of avoiding the appearance of ghosts and providing clearly defined high quality prints.

Although the further group (or groups) of distributor rollers per se is not linked to an ink fountain, excessive amounts of ink on the belt are automatically transferred to and stored by this group of rollers while the belt repeats its rotations. These excessive amounts of ink are used to replenish positions of the belt surface corresponding to ghost appearing portions. However, the provision of an ink fountain specially for the additional group of rollers does not so much bring about an adverse effect as promote the effect of this invention.

Since the measure taken by this invention to eliminate ghosts involves a simple construction utilizing a belt or belts, the apparatus embodying the invention is inexpensive to manufacture and is of a very high utility value for industrial applications.

Other objects and advantages of this invention will be apparent from the following description.

BRIEF DESCRIPTION OF THE DRAWINGS

The drawings illustrate an ink supplying apparatus for a printing machine embodying this invention, in which.

DESCRIPTION OF THE PREFERRED EMBODIMENTS

Figure 1:
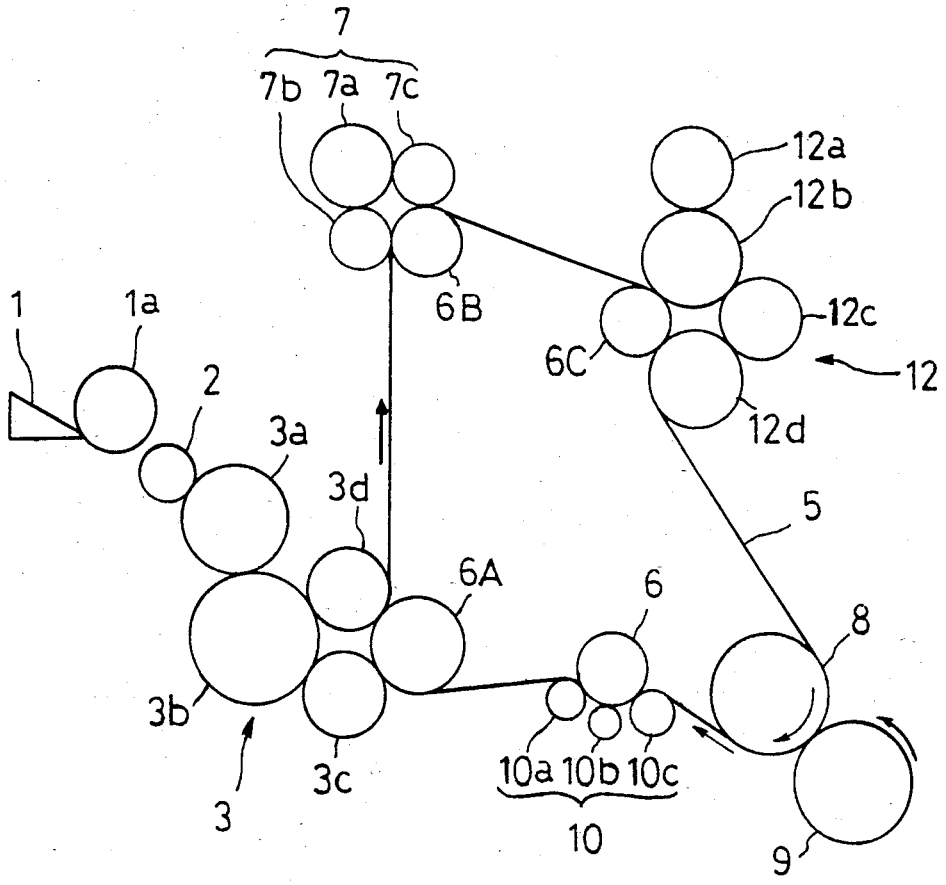
FIG. 1 is a schematic view showing how one embodiment of this invention operates.

Referring to FIG. 1, an ink fountain 1 of a printing machine, not shown as a whole thereof, has an ink fountain roller 1*a* with a lifter roller 2 rotatable in contact with or in a position away from the ink fountain roller 1*a* to pick up ink from the ink fountain 1. Number 3 indicates a first group of distributor rollers 3*a*, 3*b*, 3*c* and 3*d* rotatable in contact with one another with, one of the rollers 3*a* being disposed adjacent the lifter roller 2 to receive the ink therefrom. A guide or pressing roller 6A is provided to be rotatable and to press upon rollers 3*c* and 3*d* of the first group of rollers 3 with a predetermined pressure. Number 9 indicates a printing plate or plate cylinder rotatable to permit printing paper to receive images by known means. In the case of offset printing, for example, a further transfer cylinder is provided to transfer images to printing paper in conventional practice. Number 8 indicates a pressing cylinder pressing upon the plate cylinder 9 with a predetermined pressure. Number 5 indicates an endless belt extending from the roller 6A and rollers 3*c* and 3*d* of the first group of rollers 3 and to the pressing cylinder 8 and the plate cylinder 9. The endless belt 5 has an outer face comprising a soft rubber layer of suitable thickness to carry the ink and transfer the ink to the plate cylinder 9. Number 7 indicates a second group of distributor rollers comprising three rollers 7*a*, 7*b* and 7*c* arranged downstream of the first group of distributor rollers 3 with respect to movement of the endless belt 5. The three rollers 7*a*, 7*b* and 7*c* are rotatable in contact with one another, with rollers 7*b* and 7*c* contacting the outer face of the belt 5. Number 6B indicates a pressing roller provided to be rotatable and to press the endless belt 5 against rollers 7*b* and 7*c* with a predetermined pressure. Number 12 indicates a third group of distributor rollers comprising rollers 12*a*, 12*b*, 12*c* and 12*d* arranged downstream of the second group of distributor rollers 7 with respect to the movement of the endless belt 5. Rollers 12*a*, 12*b*, 12*c* and 12*d* are rotatable in contact with one another, with rollers 12*b* and 12*d* contacting the outer face of the belt 5. Number 6C indicates a pressing roller provided to be rotatable and to press the endless belt 5 against rollers 12*b* and 12*d* with a predetermined pressure. Number 10 indicates a fourth group of distributor rollers comprising rollers 10*a*, 10*b* and 10*c* rotatable independently of one another and arranged to contact the outer face of the endless belt 5 between the plate cylinder 9 and the first group of distributor rollers 3. Roller 10*b*, positioned between roller 10*a* and roller 10*c* is slidable along an axis thereof while in rotation. A mechanism for causing this sliding movement is known per se and its explanation is omitted from this specification. Rollers 3*b*, 7*a* and 12*c* in the first to third groups of rollers also are not only rotatable but slidable along their respective axes. The endless belt 5 is driven by an electric motor (not shown) operatively connected to the pressing cylinder 8. Rollers 3*b*, 7*a*, 12*c* and 10*b* are driven in synchronism with the pressing cylinder 8.

The described apparatus operates as follows:

The electric motor places all rollers in rotation by means of the endless belt 5, and then ink is supplied to the lifter roller 2 from the ink fountain 1. The ink is distributed by the first group of distributor rollers 3, and is applied to the outer face of the belt 5 by rollers 3*c* and 3*d*. The belt 5 carrying the ink then passes through the second group of distributor rollers 7, whereupon a superfluous portion of the ink is transferred to and retained by the second group of rollers 7. A similar action takes place at the third group of distributor rollers 12. After passing through the third group of distributor rollers 12 the endless belt 5 moves on to the plate cylinder 9 where the ink is applied to an image forming portion on the cylinder 9. As a result, an image or images are printed on printing paper in contact with the plate cylinder 9 (by means of a further transfer cylinder when appropriate). The endless belt 5 having passed the plate cylinder 9 carries reduced amounts of ink only at a position of the outer face corresponding to the above-mentioned image forming portion, which amounts are slightly leveled to become even by the fourth group of distributor rollers 10. When the belt 5 reaches the first group of distributor rollers 3, fresh ink is applied to the position of the belt 5 corresponding to the image forming portion. However, the ink is not yet sufficiently made uniform with this fresh supply of ink. Thereafter, the second group of distributor rollers 7, having ink retained thereon, supplies additional ink to the outer face of the belt 5 through rollers 7*b* and 7*c*. In this manner insufficiently uniform ink is made almost completely uniform and the position of the belt 5 corresponding to the image forming portion carries substantially an ample amount of ink. The belt 5 thereafter passes through the second group of distributor rollers 12 which similarly supplies ink supplements and makes uniform the ink on the belt 5. The belt 5 proceeds further to the plate cylinder 9, whereupon the ink carried by the outer face of the belt 5 is uniformly and evenly transferred to the impression cylinder 9. The images thus formed on the printing paper are free from ghosts, unlike the case heretofore encountered.

Figure 2:
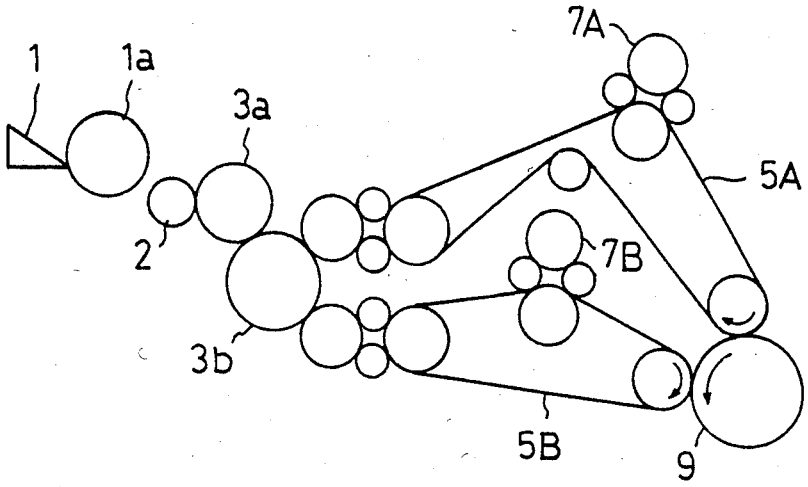
FIG. 2 is a schematic view showing how a second embodiment of this invention operates.
Figure 3:
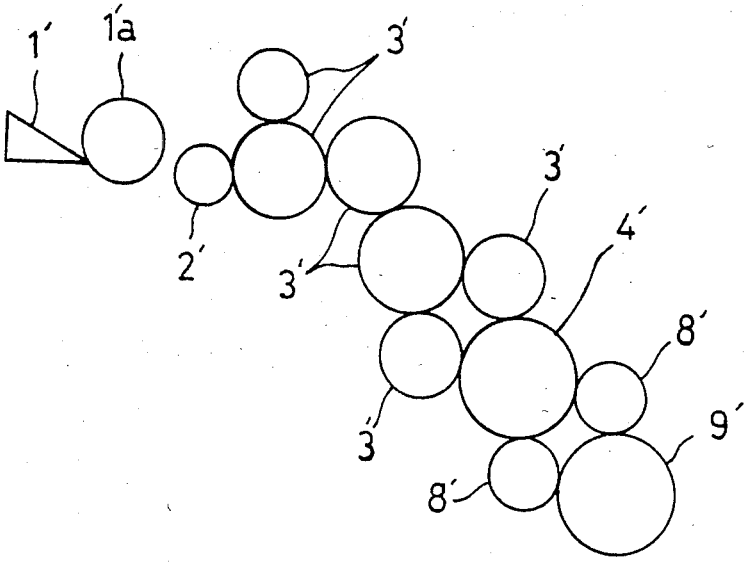
FIG. 3 PRIOR ART
FIG. 3 is a schematic view showing how a known ink supplying apparatus operates.
Figure 4:
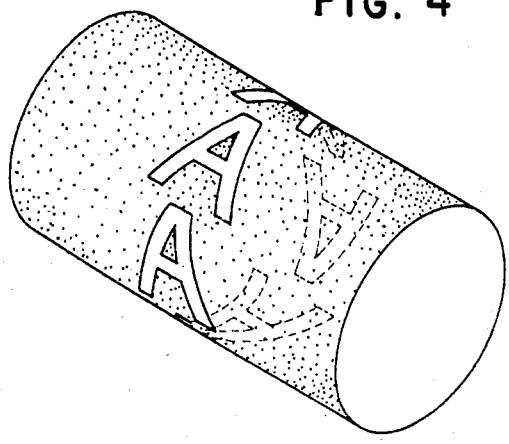
FIG. 4 is a perspective view of a form inking roller carrying proper images and ghosts.
Figure 5:
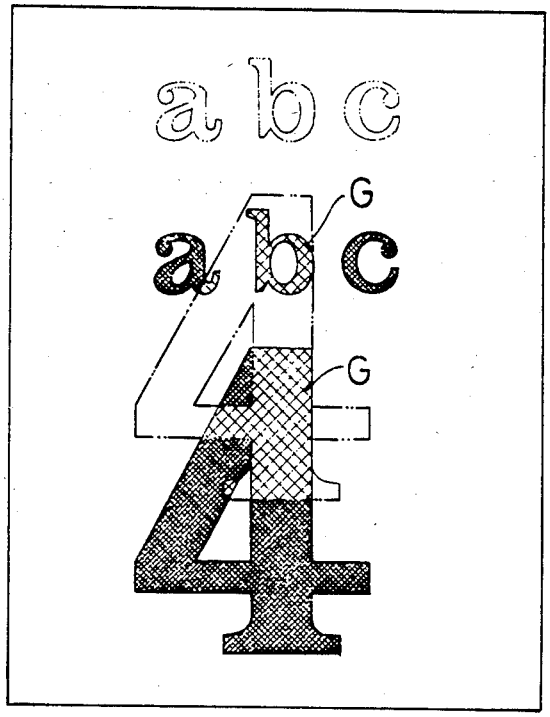
FIG. 5 is a plan view of a sheet of paper showing ghosts.

FIG. 2 shows another embodiment of this invention in which two independent endless belts 5A and 5B extend from the first group of distributor rollers 3 through respective groups of further distributor rollers 7A and 7B to the plate cylinder 9 to apply ink to the plate cylinder 9, respectively.

It will be understood that in practicing the invention it is optional to select the number of rollers to be included in each of the groups and to render certain of the rollers to be both rotatable and slidable. Furthermore, an additional group or groups of distributor rollers may be provided, which may or may not be continuous with the first group.

What is claimed is:

1. An ink supplying apparatus for a printing machine for transferring ink from an ink fountain to a plate cylinder, comprising:

an ink lifter roller disposed adjacent the ink fountain, a first group of distributor rollers continuous from the lifter roller and rotatable in contact with one another, a pressing cylinder opposed to the plate cylinder, endless belt means extending between the pressing cylinder and the plate cylinder and in contact therewith, with the endless belt means contacting at least one roller in the first group of distributor rollers, second and third groups of distributor rollers disposed downstream of the first group of distributor rollers and upstream of the pressing cylinder with respect to movement of the endless belt means, said second and third groups each including at least first and second distributor rollers directly contacting the endless belt means and at least a third roller contacting said first and second rollers without directly contacting the endless belt means, said third roller in said second and third groups of distributor rollers being slidable along its axis while in rotation, and a fourth group of distributor rollers disposed in contact with the endless belt means and positioned downstream of the pressing cylinder with respect to movement of the endless belt means and including at least one roller directly contacting the endless belt means and slidable along its axis while in rotation.

2. The ink supplying apparatus of claim 1 wherein the fourth group of distributor rollers is positioned upstream of the first group of distributor rollers with respect to movement of the endless belt means.

* * * * *